US010087714B2

(12) United States Patent
Harper et al.

(10) Patent No.: US 10,087,714 B2
(45) Date of Patent: Oct. 2, 2018

(54) TUBULAR ASSEMBLY INCLUDING A SLIDING SLEEVE HAVING A DEGRADABLE LOCKING ELEMENT

(71) Applicants: Jason M. Harper, Cypress, TX (US); James G. King, Kingwood, TX (US); James Scott Sanchez, Tomball, TX (US)

(72) Inventors: Jason M. Harper, Cypress, TX (US); James G. King, Kingwood, TX (US); James Scott Sanchez, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/458,237

(22) Filed: Mar. 14, 2017

(65) Prior Publication Data

US 2017/0183937 A1 Jun. 29, 2017

Related U.S. Application Data

(63) Continuation-in-part of application No. 14/487,812, filed on Sep. 16, 2014.

(51) Int. Cl.

| | |
|---|---|
| ***E21B 34/14*** | (2006.01) |
| ***E21B 23/00*** | (2006.01) |
| *E21B 34/00* | (2006.01) |

(52) U.S. Cl.

CPC ..... *E21B 34/14* (2013.01); *E21B 23/004* (2013.01); *E21B 2034/007* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,970,147 | A * | 7/1976 | Jessup | E21B 34/102 166/323 |
| 4,828,037 | A | 5/1989 | Lindsey et al. | |
| 5,709,269 | A | 1/1998 | Head | |
| 6,834,726 | B2 | 12/2004 | Giroux et al. | |
| 2003/0019630 | A1 | 1/2003 | Freiheit et al. | |

(Continued)

OTHER PUBLICATIONS

International Search Report dated Oct. 23, 2015 in corresponding International Application No. PCT/US2015/044949, 3 pages.

(Continued)

*Primary Examiner* — David J Bagnell
*Assistant Examiner* — Ronald D Runyan
(74) *Attorney, Agent, or Firm* — Cantor Colburn LLP

(57) ABSTRACT

A tubular assembly includes a tubular having at least one opening. A slidable sleeve is slidingly mounted relative to the tubular. The slidable sleeve is shiftable between a first position, and a second position. A biasing member selectively biases the slidable sleeve in one of the first position and the second position. A degradable locking member is mounted relative to one of the tubular and the slidable sleeve. The degradable locking member selectively retains the slidable sleeve in the other of the first position and the second position. The degradable locking member is configured to degrade when exposed to a downhole fluid allowing the biasing member to shift the slidable sleeve back to the one of the first position and the second position.

19 Claims, 10 Drawing Sheets

(56) References Cited

U.S. PATENT DOCUMENTS

| | | | | |
|---|---|---|---|---|
| 2006/0042798 | A1* | 3/2006 | Badalamenti | E21B 21/10 166/285 |
| 2006/0124310 | A1* | 6/2006 | Lopez de Cardenas | E21B 34/06 166/313 |
| 2008/0066923 | A1 | 3/2008 | Xu | |
| 2009/0025940 | A1 | 1/2009 | Rytlewski | |
| 2009/0139726 | A1 | 6/2009 | Gomez | |
| 2011/0135953 | A1 | 6/2011 | Xu et al. | |
| 2011/0253383 | A1 | 10/2011 | Porter et al. | |
| 2012/0111574 | A1 | 5/2012 | Desranleau et al. | |
| 2013/0043047 | A1 | 2/2013 | Fay | |
| 2014/0246208 | A1 | 9/2014 | Themig et al. | |
| 2016/0076337 | A1 | 3/2016 | Harper et al. | |

OTHER PUBLICATIONS

Written Opinion of the International Search Authority dated Oct. 23, 2015 in corresponding International Application No. PCT/US2015/044949, 7 pages.

* cited by examiner

TUBULAR ASSEMBLY INCLUDING A SLIDING SLEEVE HAVING A DEGRADABLE LOCKING ELEMENT

CROSS-REFERENCE TO PRIOR APPLICATIONS

This application is a continuation-in-part of U.S. patent application Ser. No. 14/487,812, filed on Sep. 16, 2014, which is hereby expressly incorporated herein by reference in its entirety.

BACKGROUND

Hydrocarbon drilling and recovery systems employ strings of tubulars that extend downhole. Often times one or more of the tubulars include openings. The openings may be selectively exposed to allow downhole fluids to pass into the string of tubulars. In some cases, a sliding sleeve is deployed to expose the openings. More specifically, the string of tubulars is positioned downhole and, at a desired time, the sliding sleeve is shifted to expose the openings. Once opened, the sleeve may be locked in place by a locking mechanism. The lock allows, for example, coiled tubing to be run downhole through the tubular without inadvertently closing the sleeve. Once locked, the sleeve may not be closed. Accordingly, improvements in sleeve locking and retaining devices are well received by the industry.

SUMMARY

A tubular assembly includes a tubular having at least one opening. A slidable sleeve is slidingly mounted relative to the tubular. The slidable sleeve is shiftable between a first position, and a second position. A biasing member selectively biases the slidable sleeve in one of the first position and the second position. A degradable locking member is mounted relative to one of the tubular and the slidable sleeve. The degradable locking member selectively retains the slidable sleeve in the other of the first position and the second position. The degradable locking member is configured to degrade when exposed to a downhole fluid allowing the biasing member to shift the slidable sleeve back to the one of the first position and the second position.

A resource recovery and exploration system includes a surface system, a wellbore formed in a formation, and a tubular assembly extending down the wellbore into the formation. The tubular assembly includes a tubular having at least one opening. A slidable sleeve is slidingly mounted relative to the tubular. The slidable sleeve is shiftable between a first position, and a second position. A biasing member selectively biases the slidable sleeve in one of the first position and the second position. A degradable locking member is mounted relative to one of the tubular and the slidable sleeve. The degradable locking member selectively retaining the slidable sleeve in the other of the first position and the second position. The degradable locking member is configured to degrade when exposed to a downhole fluid allowing the biasing member to shift the slidable sleeve back to the one of the first position and the second position.

A method of operating a downhole slidable sleeve includes running a tubular assembly including a tubular having a slidable sleeve into a wellbore, shifting the slidable sleeve relative to the tubular from a first position to a second position, loading a biasing member with the slidable sleeve in the second position, locking the slidable sleeve in the second position with a degradable locking member, and exposing the degradable locking member to a downhole fluid causing the degradable locking member to degrade.

BRIEF DESCRIPTION OF THE DRAWINGS

Referring now to the drawings wherein like elements are numbered alike in the several Figures.

DETAILED DESCRIPTION

Figure 1:
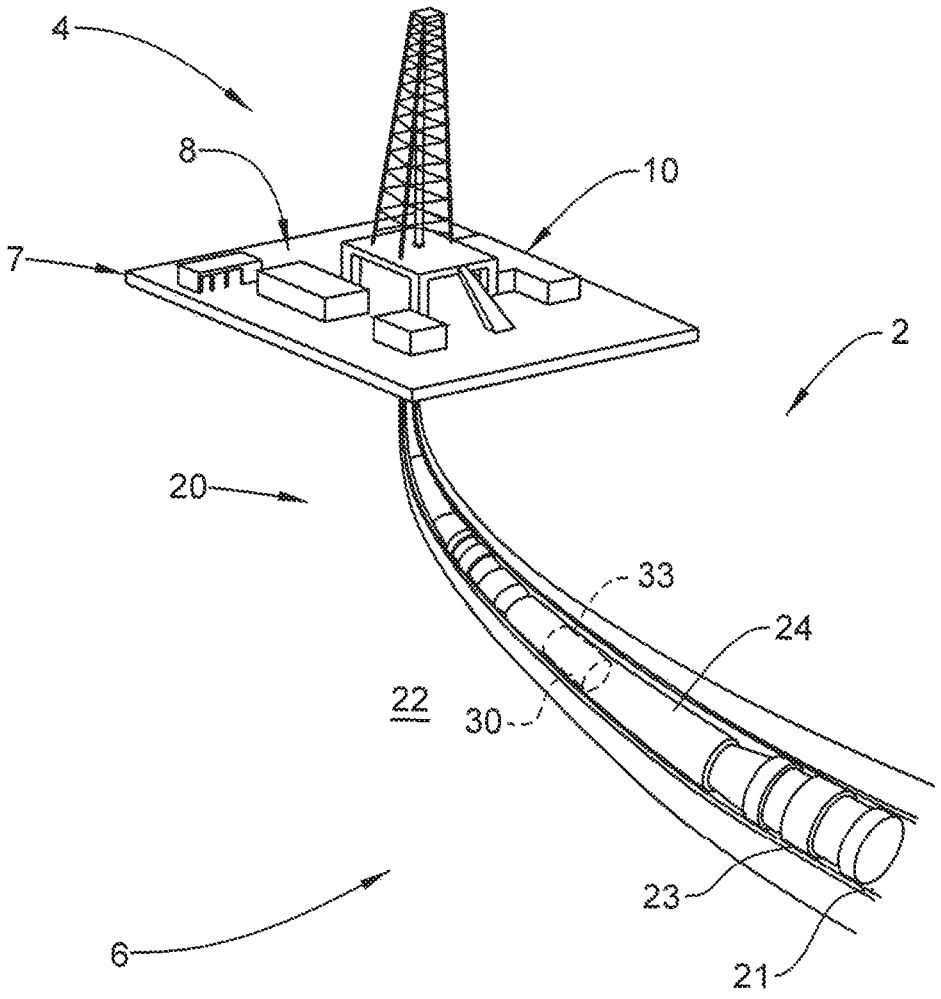
FIG. 1 depicts a resource extraction system including a tubular assembly having a slidable sleeve with a degradable locking member, in accordance with an aspect of an exemplary embodiment.

A resource recovery and exploration system, in accordance with an exemplary embodiment, is indicated generally at 2, in FIG. 1. Resource extraction system 2 includes a surface system 4 operatively connected to a downhole system 6. Surface system 4 may include a platform 7 that supports pumps 8 that aid in completion and/or extraction processes as well as fluid storage 10. Fluid storage 10 may contain a completion fluid that is introduced into downhole system 6. It is to be understood that surface system 4 may take on a variety of forms and should not be limited to the particular depiction presented in FIG. 1.

Figure 2:
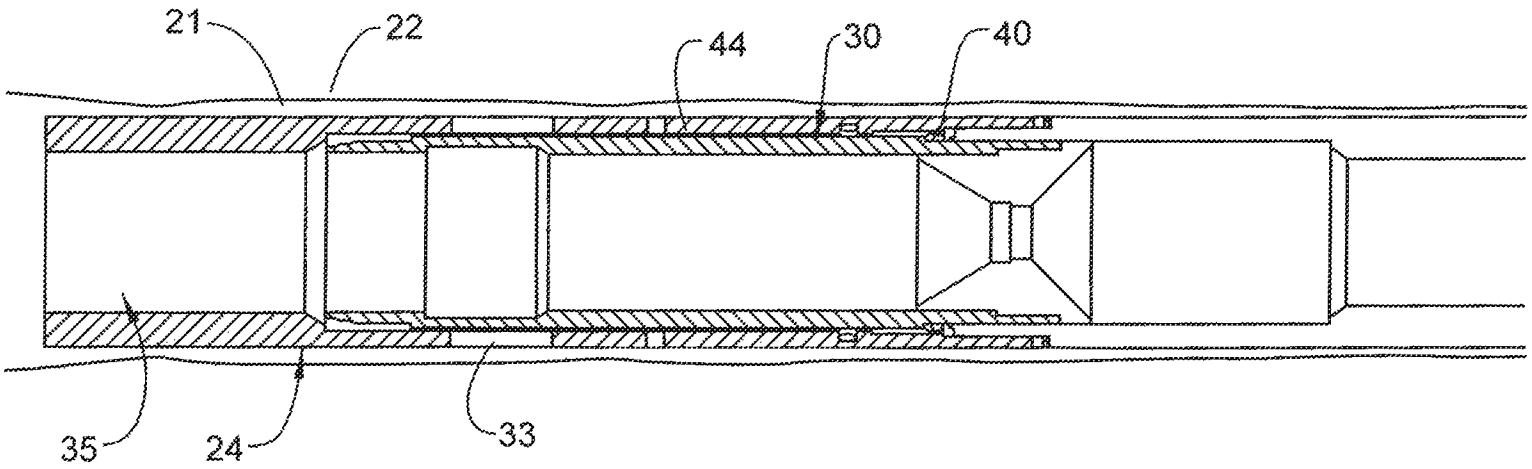
FIG. 2 depicts the tubular assembly of FIG. 1 with the slidable sleeve in a closed configuration.
Figure 3:
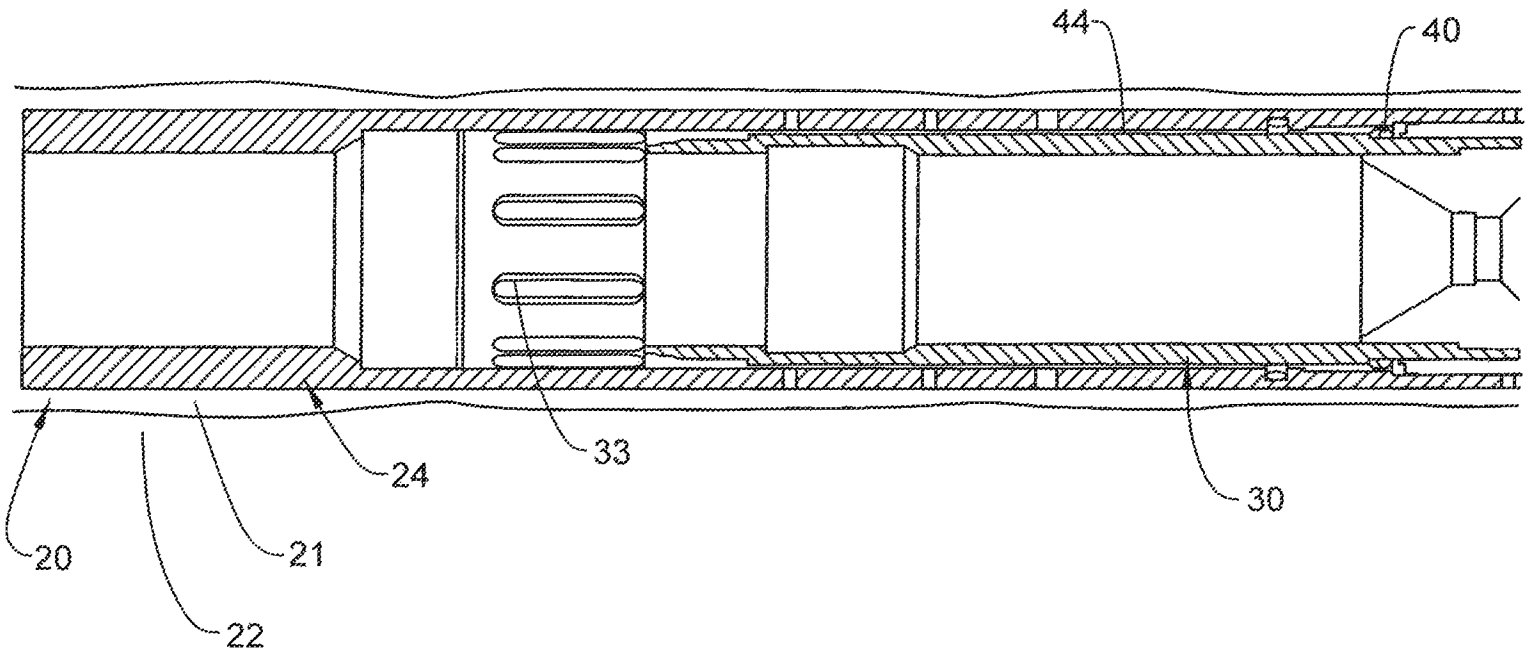
FIG. 3 depicts the tubular assembly with the slidable sleeve locked in an open configuration through the degradable locking member of FIG. 1.

Downhole system 6 may include a downhole string of tubulars 20 that is extended into a wellbore 21 formed in formation 22. A well casing 23 extends down wellbore 21 to provide stability. Downhole string of tubulars 20 may include a tubular 24 and a slidable sleeve 30. Slidable sleeve 30 may be selectively shifted from a first or closed configuration (FIG. 2) to a second or open configuration (FIG. 3) exposing a plurality of openings 33 formed in tubular 24. Of course, it is to be understood that the first configuration could represent an open configuration and the second configuration could represent a closed configuration. Slidable sleeve 30 is shifted from one configuration to another as will be detailed herein. Openings 33 allow fluid to pass from wellbore 21 into an interior portion 35 of tubular string 20 and vice versa. In the exemplary embodiment shown, slidable sleeve 30 is arranged radially inwardly of tubular 24. However, it should be understood that the relative position of slidable sleeve 30 and tubular 24 may vary.

In accordance with an aspect of an exemplary embodiment, a degradable locking member 40 retains slidable sleeve 30 in the open configuration. In the exemplary embodiment shown, locking member 40 is positioned radially outwardly of an outer surface (not separately labeled) of slidable sleeve 30. When in the open configuration, degradable locking member 40 nests within an annular groove 44 formed in the outer surface of slidable sleeve 30. When nested within annular groove 44, slidable sleeve 30 is prevented from shifting from the open configuration. In this manner, operators may introduce components, such as various tools, coiled tubing and the like, into downhole tubular string 20 without inadvertently shifting slidable sleeve 30 to the closed configuration. In previous systems, slidable sleeve 30 was forever prevented from being closed. In accordance with the exemplary embodiment, degradable locking member 40 will, over time, mechanically and/or chemically degrade. When degraded to a particular degree, slidable sleeve 30 may be shifted against degradable locking member 40. Further shifting will cause degradable locking member 40 to release. At such time, slidable sleeve 30 may be freely shifted from the open configuration to the closed configuration.

Figure 4:
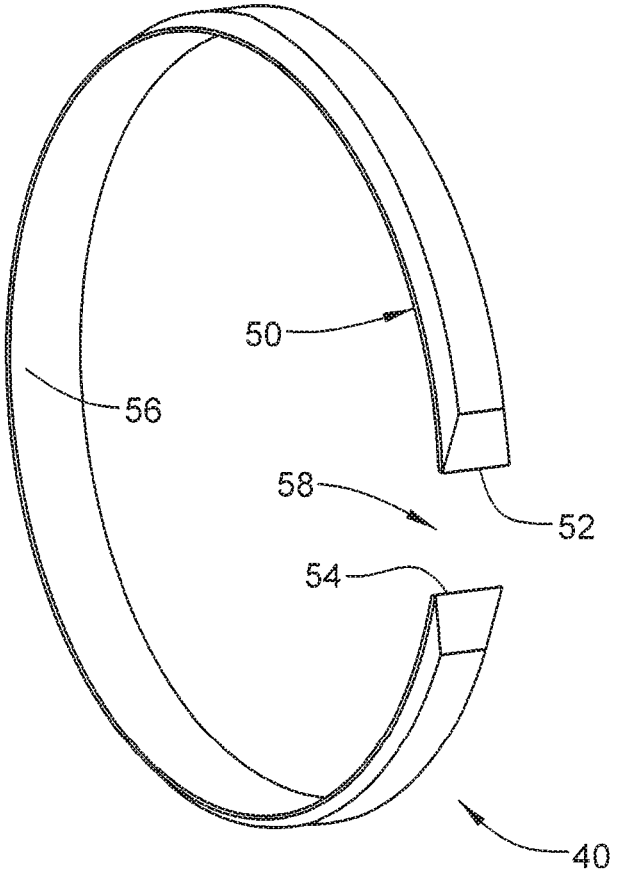
FIG. 4 depicts a degradable locking member, in accordance with an aspect of an exemplary embodiment.
Figure 5:
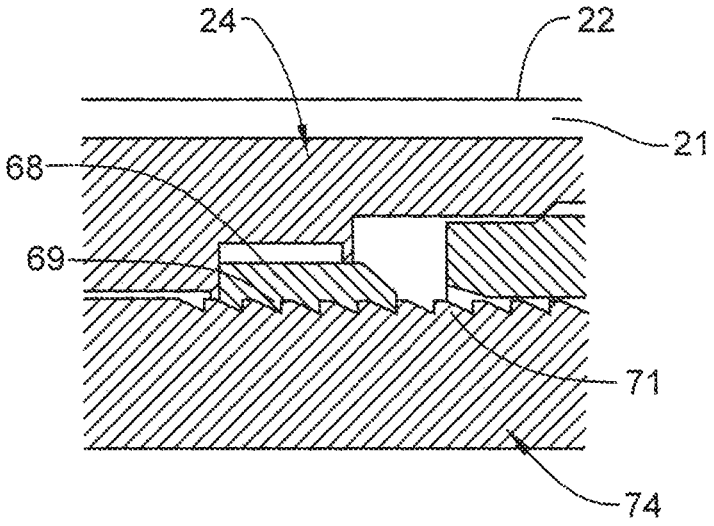
FIG. 5 depicts a degradable locking member, in accordance with another aspect of an exemplary embodiment.
Figure 6:
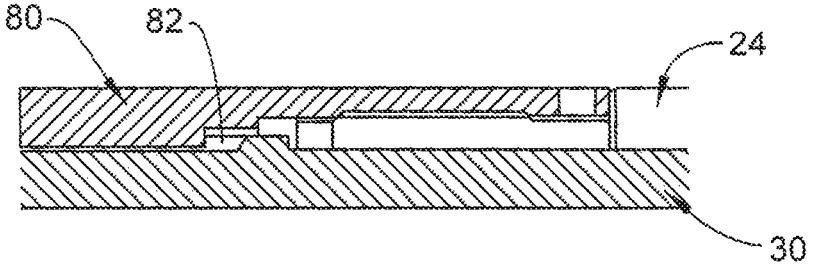
FIG. 6 depicts a degradable locking member, in accordance with yet another aspect of an exemplary embodiment.

In accordance with one aspect of an exemplary embodiment, degradable locking member 40 may take the form of a degradable snap ring 50, illustrated in FIG. 4. Degradable snap ring 50 extends from a first end 52 to a second end 54 through a degradable intermediate portion 56. First end 52 may be spaced from second end 54 defining a discontinuity 58. In accordance with another aspect of an exemplary embodiment, locking member 40 may take the form of a body lock ring 68, illustrated in FIG. 5. Body lock ring 68 may include a plurality of teeth 69 that meshingly engage with another plurality of teeth 71 formed on an outer surface (not separately labeled) of a slidable sleeve 74. In accordance with yet another aspect of an exemplary embodiment, degradable locking member 40 may take the form of a collet 80 arranged radially outwardly of tubular 24. Collet 80 includes a degradable locking portion 82 that, once degraded, allows slidable sleeve 30 to return to a closed configuration.

Figure 7:
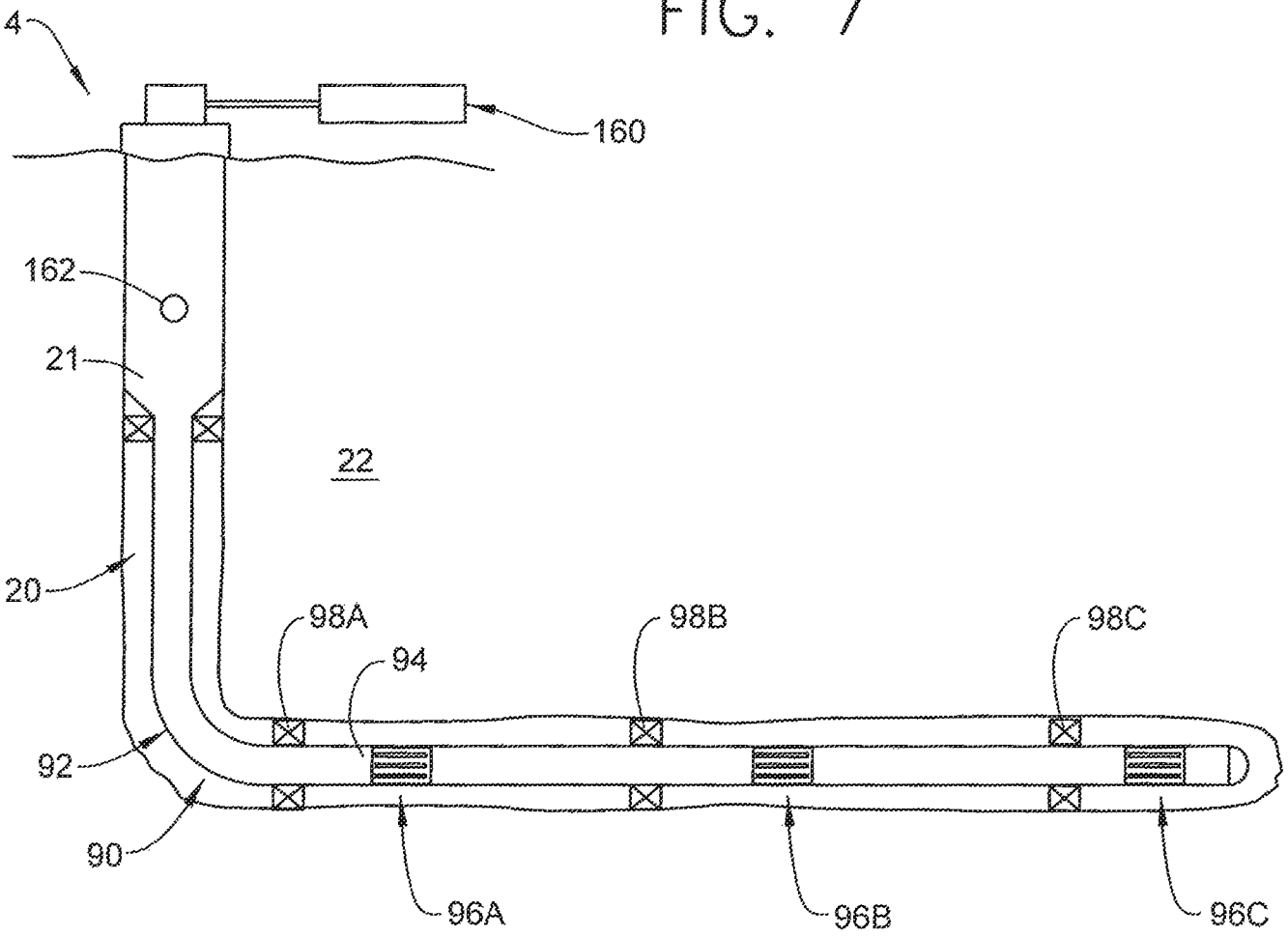
FIG. 7 depicts a system of tubulars including a slidable sleeve with a degradable locking member, in accordance with another aspect of an exemplary embodiment.
Figure 8:
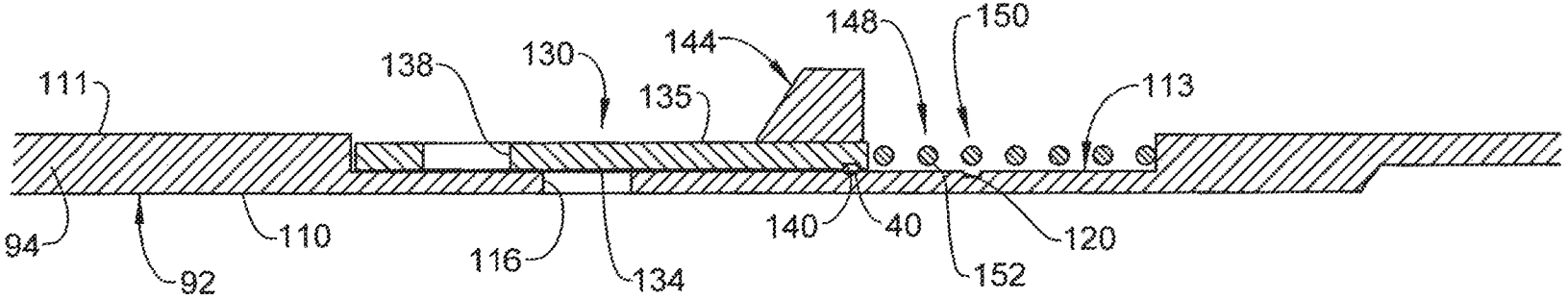
FIG. 8 depicts the slidable sleeve positioned in a first configuration, in accordance with an aspect of an exemplary embodiment.

Reference will now follow to FIGS. 7-11 in describing an implementation of degradable locking member 40 in accordance with an aspect of an exemplary embodiment. In FIG. 7, a system of tubulars 90 extends into wellbore 21. System of tubulars 20 includes at least one tubular assembly 92 having at least one tubular 94. A plurality of zones 96A, 96B, and 96C separated by a corresponding plurality of packers 98A, 98B, and 98C may be defined along system of tubulars. It is to be understood that the number and relative position of the zones along system of tubulars 94 as well as the number and location of the packers may vary. Reference will now follow to FIG. 8 in describing zone 96A with an understanding that zones 96B and 96C may include similar structure.

Figure 10:
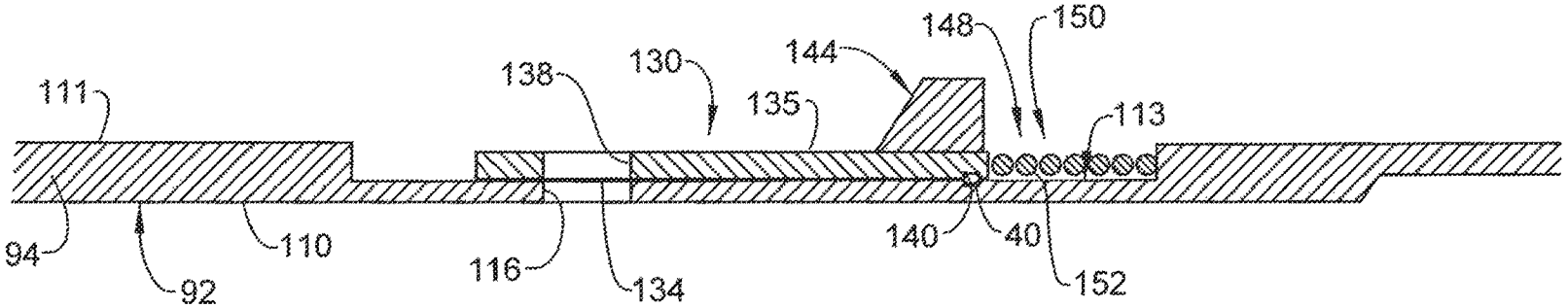
FIG. 10 depicts the slidable sleeve shifted to a second configuration against a biasing member and being locked in place by the degradable locking member, in accordance with an aspect of an exemplary embodiment.

As shown in FIG. 8, tubular 94 includes an outer surface 110 and an inner surface 111 having a recess 113. At zone 96A at least one opening 116 extends through tubular 94 in recess 113. It is to be understood that the number and relative position of openings may vary. Tubular 94 is also shown to include an annular groove 120 arranged in recess 113. Annular groove 120, as will be described herein, is selectively receptive of degradable locking member 40. Tubular 94 also includes a slidable sleeve 130 arranged in recess 113. Specifically, slidable sleeve is shiftable between a first position, as shown in FIG. 8 and a second position as shown in FIG. 10.

Slidable sleeve 130 includes an outer surface portion 134 and an inner surface portion 135. An at least one opening portion 138 extends through slidable sleeve 130. At least one opening portion 138 in slidable sleeve 130 selectively registers with at least one opening 116 in recess 113 allowing fluid to flow out of and/or into tubular 94. It is to be understood that the particular orientation of slidable sleeve shown in FIG. 8 is but an exemplar. Slidable sleeve could be configured to shift from the first position in which at least one opening 116 in recess 113 and at least one opening portion 138 are aligned to a second position in which at least one opening 116 and at least one opening portion 138 are misaligned thereby preventing fluid flow into and/or out of tubular 94.

Slidable sleeve 130 also includes an annular groove portion 140 that may be receptive of degradable locking member 40. Slidable sleeve 130 may be also provided with a ball seat 144. As will be detailed herein, when slidable sleeve 130 is shifted, degradable locking member 40 may nest within annular groove 120 in recess 113. In this manner, slidable sleeve may be temporarily locked in place. Upon shifting, slidable sleeve may load a biasing member 148 provided in recess 113. Biasing member 148 may take the form of a spring 150 having one or more coils 152 that apply a force to slidable sleeve 130. It is to be understood that the particular form of spring 150 may vary. Once degradable locking member 40 begins to disintegrate, biasing member 148 returns slidable sleeve 130 to the first position.

Figure 9:
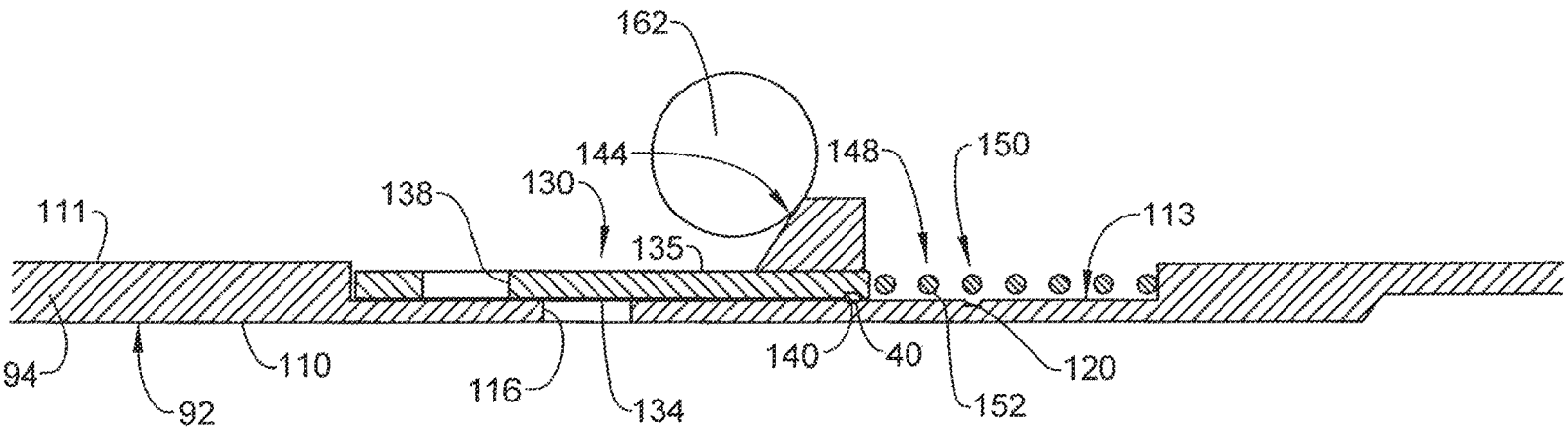
FIG. 9 depicts a drop ball engaging a ball seat of the slidable sleeve of FIG. 8.

Slidable sleeve 130 may be shifted by fluid pressure introduced into system of tubulars 20. For example, in place of a platform, surface system 4 may include a pump (FIG. 7) that may be operated to introduce a fluid (not shown) into system of tubulars 20. The fluid guides a drop ball 162 onto ball seat 144 as shown in FIG. 9. Fluid pressure is increased by pump 160 against drop ball 162 causing slidable sleeve 130 to shift from the first position (FIG. 8) to the second position (FIG. 10) loading biasing member 148. In the second position, degradable locking member 40 nests within annular grove 120 temporarily fixing slidable sleeve 130 in place. In the configuration shown, in the second position, at least one opening portion 138 in slidable sleeve 130 registers with at least one opening 116 in tubular 94 allowing fluid flow therebetween. Drop ball 162 may be allowed to dissolve, may be pressured passed ball seat 144 or may be flowed out of wellbore 21. It is to be understood that slidable sleeve 130 may be selectively secured to tubular 94 through one or more shear screws (not shown). Alternatively, slidable sleeve 130 may be secured to tubular 94 by a collet (also not shown).

Figure 11:
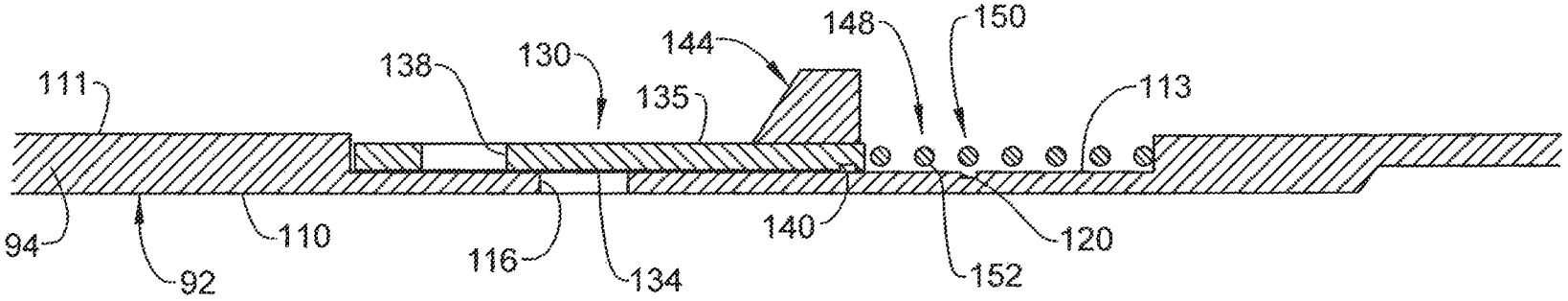
FIG. 11 depicts the biasing member shifting the slidable sleeve back to the first configuration following degradation of the degradable locking member, in accordance with an aspect of an exemplary embodiment.

After a period of time and exposure to downhole fluids, degradable locking ring may dissolve as shown in FIG. 11 unlocking slidable sleeve 130 from tubular 94. Once unlocked, biasing member 148 shifts slidable sleeve 130 back to the first position. When shifted back to the first position, it is to be understood that slidable sleeve 120 may be selectively secured in place by a collet (not shown). It is to be understood that the term "downhole fluid" may include fluids entering tubular 94 from wellbore 21 and/or formation 22 or fluids that are pumped into system of tubulars 20. It is also to be understood that degradable locking ring 40 need not fully dissolve before slidable sleeve is unlocked. Degradable locking member 40 may partially dissolve and subsequently fracture allowing biasing member 148 to shift slidable sleeve back to the first position.

At this point, it should be understood that degradable locking member 40 may be formed in whole, or in part, from a material that disintegrates when exposed to downhole fluids. As will be discussed more fully below, degradable locking member 40 may be provided with a coating that may delay disintegration of degradable locking member 40 for a period of time. As will be discussed more fully below, coatings and underlying body materials may take on a variety of forms.

In accordance with an aspect of an exemplary embodiment, degradable locking member 40 may be formed from materials that are degradable by exposure to a variety of fluids capable of being pumped, present, or delivered downhole such as water, acid, oil, etc. The degradable material could be a metal, a composite, a polymer, etc., or any other material that is suitably degradable and that can withstand the loads during run-in, etc. In one embodiment, the degradable locking member 40 may be manufactured from a high strength controlled electrolytic metallic material and is degradable by brine, acid, or aqueous fluid.

That is, materials appropriate for the purpose of degradable locking member 40 described herein are lightweight, high-strength metallic materials. Examples of suitable materials, e.g., high strength controlled electrolytic metallic materials, and their methods of manufacture are given in United States Patent Publication No. 2011/0135953 (Xu, et al.), which Patent Publication is hereby incorporated by reference in its entirety. These lightweight, high-strength, selectively and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications.

Suitable core materials include electrochemically active metals having a standard oxidation potential greater than or equal to that of Zn, including Mg, Al, Mn or Zn or alloys or combinations thereof. For example, tertiary Mg—Al—X alloys may include, by weight, up to about 85% Mg, up to about 15% Al and up to about 5% X, where X is another material. The core material may also include a rare earth element such as Sc, Y, La, Ce, Pr, Nd or Er, or a combination of rare earth elements. In other embodiments, the materials could include other metals having a standard oxidation potential less than that of Zn. Also, suitable non-metallic materials include ceramics, glasses (e.g., hollow glass microspheres), carbon, or a combination thereof. In one embodiment, the material has a substantially uniform average thickness between dispersed particles of about 50 nm to about 5000 nm. In one embodiment, the coating layers may be formed from Al, Ni, W or $Al_2O_3$, or combinations thereof. In one embodiment, the coating may be a multi-layer coating, for example, comprising a first Al layer, an $Al_2O_3$ layer, and a second Al layer. In some embodiments, the coating may have a thickness of about 25 nm to about 2500 nm.

These powder compacts provide a unique and advantageous combination of mechanical strength properties, such as compression and shear strength, low density and selectable and controllable corrosion properties, particularly rapid and controlled dissolution in various borehole fluids. The fluids may include any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials.

Embodiment 1

A tubular assembly comprising: a tubular including at least one opening; a slidable sleeve slidingly mounted relative to the tubular, the slidable sleeve being shiftable between a first position, and a second position; a biasing member selectively biasing the slidable sleeve in one of the first position and the second position; and a degradable locking member mounted relative to one of the tubular and the slidable sleeve, the degradable locking member selectively retaining the slidable sleeve in the other of the first position and the second position, the degradable locking member being configured to degrade when exposed to a downhole fluid allowing the biasing member to shift the slidable sleeve back to the one of the first position and the second position.

Embodiment 2

The tubular assembly according to embodiment 1, wherein the biasing member comprises a spring having one or more coils.

Embodiment 3

The tubular assembly according to embodiment 1, wherein the slidable sleeve includes at least one opening portion, in the second position the at least one opening portion registers with the at least one opening in the tubular.

Embodiment 4

The tubular assembly according to embodiment 1, wherein the slidable sleeve includes a ball seat.

Embodiment 5

The tubular assembly according to embodiment 1, wherein the tubular includes an outer surface and an inner surface, the inner surface including an annular groove.

Embodiment 6

The tubular assembly according to embodiment 5, wherein the slidable sleeve includes an outer surface portion and an inner surface portion, the outer surface portion including an annular groove portion, the degradable locking member being carried in the annular groove of the one of the tubular and the slidable sleeve in the first position and nested within the annular groove of the tubular and the slidable sleeve in the second position.

Embodiment 7

The tubular assembly according to embodiment 1, wherein the degradable locking member comprises a degradable snap ring.

Embodiment 8

The tubular assembly according to embodiment 7, wherein the degradable snap ring extends from a first end to a second end through a degradable intermediate portion, the first end being spaced from the second end defining a discontinuity in the degradable snap ring.

Embodiment 9

A resource recovery and exploration system comprising: a surface system; a wellbore formed in a formation; and a tubular assembly extending down the wellbore into the formation, the tubular assembly comprising: a tubular including at least one opening; a slidable sleeve slidingly mounted relative to the tubular, the slidable sleeve being shiftable between a first position, and a second position; a biasing member selectively biasing the slidable sleeve in one of the first position and the second position; and a degradable locking member mounted relative to one of the tubular and the slidable sleeve, the degradable locking member selectively retaining the slidable sleeve in the other of the first position and the second position, the degradable locking member being configured to degrade when exposed to a downhole fluid allowing the biasing member to shift the slidable sleeve back to the one of the first position and the second position.

Embodiment 10

The resource exploration and recovery system according to embodiment 9, wherein the biasing member comprises a spring having one or more coils.

Embodiment 11

The resource exploration and recovery system according to embodiment 9, wherein the slidable sleeve includes at least one opening portion, in the second position the at least one opening portion registers with the at least one opening in the tubular.

Embodiment 12

The resource exploration and recovery system according to embodiment 9, wherein the slidable sleeve includes a ball seat.

Embodiment 13

The resource exploration and recovery system according to embodiment 9, wherein the tubular includes an outer surface and an inner surface, the inner surface including an annular groove.

Embodiment 14

The resource exploration and recovery system according to embodiment 13, wherein the slidable sleeve includes an outer surface portion and an inner surface portion, the outer surface portion including an annular groove portion, the degradable locking member being carried in the annular groove of the one of the tubular and the slidable sleeve in the first position and nested within the annular groove of the tubular and the slidable sleeve in the second position.

Embodiment 15

The resource exploration and recovery system according to embodiment 9, wherein the degradable locking member comprises a degradable snap ring.

Embodiment 16

The resource exploration and recovery system according to embodiment 15, wherein the degradable snap ring extends from a first end to a second end through a degradable intermediate portion, the first end being spaced from the second end defining a discontinuity in the degradable snap ring.

Embodiment 17

A method of operating a downhole slidable sleeve comprising: running a tubular assembly including a tubular having a slidable sleeve into a wellbore; shifting the slidable sleeve relative to the tubular from a first position to a second position; loading a biasing member with the slidable sleeve in the second position; locking the slidable sleeve in the second position with a degradable locking member; and exposing the degradable locking member to a downhole fluid causing the degradable locking member to degrade.

Embodiment 18

The method of embodiment 17, further comprising: biasing the slidable sleeve back to the first position with the biasing member following the degradable locking member substantially degrading.

Embodiment 19

The method of embodiment 18, wherein shifting the slidable sleeve from the first position to the second position aligns at least one opening formed in the tubular with at least one opening portion formed in the slidable sleeve.

Embodiment 20

The method of embodiment 19, wherein shifting the slidable sleeve back to the first position with the biasing member misaligns the at least one opening and the at least one opening portion.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A tubular assembly comprising:

a tubular including at least one opening;

a slidable sleeve slidingly mounted relative to the tubular, the slidable sleeve being shiftable between a first position, and a second position;

a biasing member mounted between the tubular and the slidable sleeve in a substantially unbiased configuration, the biasing member selectively biasing the slidable sleeve in one of the first position and the second position; and a degradable locking member mounted to the slidable sleeve, the degradable locking member selectively retaining the slidable sleeve in the other of the first position and the second position, the degradable locking member being configured to degrade when exposed to a downhole fluid allowing the biasing member to shift the slidable sleeve back to the one of the first position and the second position.

2. The tubular assembly according to claim 1, wherein the biasing member comprises a spring having one or more coils.

3. The tubular assembly according to claim 1, wherein the slidable sleeve includes at least one opening portion, in the second position the at least one opening portion registers with the at least one opening in the tubular.

4. The tubular assembly according to claim 1, wherein the slidable sleeve includes a ball seat.

5. The tubular assembly according to claim 1, wherein the tubular includes an outer surface and an inner surface, the inner surface including an annular groove.

6. The tubular assembly according to claim 5, wherein the slidable sleeve includes an outer surface portion and an inner surface portion, the outer surface portion including an annular groove portion, the degradable locking member being carried in the annular groove of the slidable sleeve in the first position and nested within the annular groove of the tubular in the second position.

7. The tubular assembly according to claim 1, wherein the degradable locking member comprises a degradable snap ring.

8. The tubular assembly according to claim 7, wherein the degradable snap ring extends from a first end to a second end through a degradable intermediate portion, the first end being spaced from the second end defining a discontinuity in the degradable snap ring.

9. A resource recovery and exploration system comprising:

a surface system;

a wellbore formed in a formation; and a tubular assembly extending down the wellbore into the formation, the tubular assembly comprising:

a tubular including at least one opening;

a slidable sleeve slidingly mounted relative to the tubular, the slidable sleeve being shiftable between a first position, and a second position;

a biasing member mounted between the tubular and the slidable sleeve in a substantially unbiased configuration, the biasing member selectively biasing the slidable sleeve in one of the first position and the second position; and a degradable locking member mounted to the slidable sleeve, the degradable locking member selectively retaining the slidable sleeve in the other of the first position and the second position, the degradable locking member being configured to degrade when exposed to a downhole fluid allowing the biasing member to shift the slidable sleeve back to the one of the first position and the second position.

10. The resource exploration and recovery system according to claim 9, wherein the biasing member comprises a spring having one or more coils.

11. The resource exploration and recovery system according to claim 9, wherein the slidable sleeve includes at least one opening portion, in the second position the at least one opening portion registers with the at least one opening in the tubular.

12. The resource exploration and recovery system according to claim 9, wherein the slidable sleeve includes a ball seat.

13. The resource exploration and recovery system according to claim 9, wherein the tubular includes an outer surface and an inner surface, the inner surface including an annular groove.

14. The resource exploration and recovery system according to claim 13, wherein the slidable sleeve includes an outer surface portion and an inner surface portion, the outer surface portion including an annular groove portion, the degradable locking member being carried in the annular groove of the slidable sleeve in the first position and nested within the annular groove of the tubular in the second position.

15. The resource exploration and recovery system according to claim 9, wherein the degradable locking member comprises a degradable snap ring.

16. The resource exploration and recovery system according to claim 15, wherein the degradable snap ring extends from a first end to a second end through a degradable intermediate portion, the first end being spaced from the second end defining a discontinuity in the degradable snap ring.

17. A method of operating a downhole slidable sleeve comprising:

running a tubular assembly including a tubular having a slidable sleeve into a wellbore;

shifting the slidable sleeve relative to the tubular from a first position to a second position;

loading a biasing member with the slidable sleeve in the second position;

locking the slidable sleeve in the second position with a degradable locking member;

exposing the degradable locking member to a downhole fluid causing the degradable locking member to degrade; and biasing the slidable sleeve back to the first position with the biasing member following the degradable locking member substantially degrading.

18. The method of claim 17, wherein shifting the slidable sleeve from the first position to the second position aligns at least one opening formed in the tubular with at least one opening portion formed in the slidable sleeve.

19. The method of claim 18, wherein shifting the slidable sleeve back to the first position with the biasing member misaligns the at least one opening and the at least one opening portion.

* * * * *